US012589920B2

(12) United States Patent
Cheng

(10) Patent No.: US 12,589,920 B2
(45) Date of Patent: Mar. 31, 2026

(54) PORTABLE STORAGE CONTAINER

(71) Applicant: Luke Cheng, Syosset, NY (US)

(72) Inventor: Luke Cheng, Syosset, NY (US)

( * ) Notice: Subject to any disclaimer, the term of this patent is extended or adjusted under 35 U.S.C. 154(b) by 143 days.

(21) Appl. No.: 18/399,344

(22) Filed: Dec. 28, 2023

(65) Prior Publication Data

US 2024/0217710 A1 Jul. 4, 2024

Related U.S. Application Data

(60) Provisional application No. 63/436,771, filed on Jan. 3, 2023.

(51) Int. Cl.
*B65D 43/02* (2006.01)

(52) U.S. Cl.
CPC ..... *B65D 43/0231* (2013.01); *B65D 2313/04* (2013.01); *B65D 2543/00537* (2013.01)

(58) Field of Classification Search
CPC ..... B65D 43/0231; B65D 2313/04; B65D 2543/00537; B65D 2543/00092; B65D 2543/00527; B65D 2313/08; A61J 1/03; H04M 1/21; G06F 1/1626
See application file for complete search history.

(56) References Cited

U.S. PATENT DOCUMENTS 2,588,990 A * 3/1952 Sanchez ..... A47G 19/02 248/362
5,186,350 A * 2/1993 McBride ..... B65D 81/3886 220/729
6,390,319 B1 * 5/2002 Yu ..... B65D 81/24 220/521
2009/0200296 A1 * 8/2009 Iwasaki ..... B29C 45/33 220/254.2
2014/0246431 A1 * 9/2014 Lipson ..... B65D 51/24 239/33
2023/0078789 A1 * 3/2023 Ridgway ..... B65D 25/20 220/483
2024/0336412 A1 * 10/2024 Lara ..... F16B 47/00

* cited by examiner

*Primary Examiner* — James N Smalley
(74) *Attorney, Agent, or Firm* — LOZA & LOZA, LLP; Jun S. Ha

(57) ABSTRACT

Aspects relate to a portable storage container. The portable storage container may be detachably attached to a portable item, such as a mobile phone. The portable storage container includes an engaging component configured to detachably engage with a coupling component coupled to a portable item. The portable storage container further includes a storage component attached to the engaging component, the storage component including a first storage component part with the engaging component attached to one side of the first storage component part, the first storage component part being configured to be detachably coupled to the coupling component via the engaging component, and a second storage component part configured to detachably couple to the first storage component part. Another aspect relates to a portable storage container unit, which may include the portable storage container and a coupling component configured to be coupled to the portable item.

19 Claims, 9 Drawing Sheets

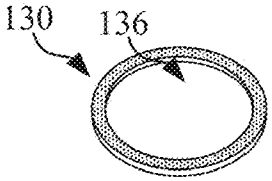
FIG. 1A
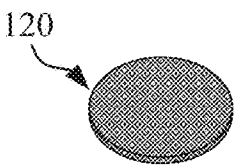
FIG. 1B
FIG. 1C
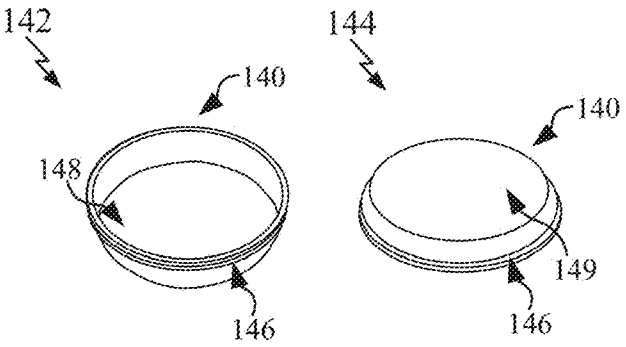
FIG. 1D
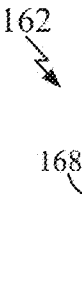
FIG. 1E
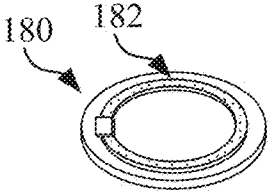
FIG. 1F

PORTABLE STORAGE CONTAINER

PRIORITY CLAIM

This application claims priority to and the benefit of provisional patent application No. 63/436,771 filed in the United States Patent & Trademark Office on Jan. 3, 2023, the entire content of which is incorporated herein by reference as if fully set forth below in its entirety and for all applicable purposes.

TECHNICAL FIELD

The disclosure discussed below relates generally to a portable storage container, more particularly to a portable storage container that can be detachably attached to a portable item.

INTRODUCTION

As people live busy lives, they are always on the go and are taking their belongings in storage containers. Hence, various types of portable storage containers have been developed to meet users' needs. A portable storage container should be easy for a user to carry while providing sufficient space to carry user's items.

BRIEF SUMMARY OF SOME EXAMPLES

The following presents a summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a form as a prelude to the more detailed description that is presented later.

In one example, a portable storage container is disclosed. The portable storage container includes an engaging component configured to detachably engage with a coupling component coupled to a portable item. The portable storage container further includes a storage component attached to the engaging component, the storage component including a first storage component part with the engaging component attached to one side of the first storage component part, the first storage component part being configured to be detachably coupled to the coupling component via the engaging component, and a second storage component part configured to detachably couple to the first storage component part.

In another example, a portable storage container unit is disclosed. The portable storage container unit includes a coupling component configured to be coupled to a portable item and a portable storage container. The portable storage container includes an engaging component configured to detachably engage with the coupling component. The portable storage container further includes a first storage component part with the engaging component attached to one side of the first storage component part, the first storage component part being configured to detachably coupled to the coupling component via the engaging component, and a second storage component part configured to detachably couple to the first storage component part.

These and other aspects of the disclosure will become more fully understood upon a review of the detailed description, which follows. Other aspects, features, and embodiments will become apparent to those of ordinary skill in the art, upon reviewing the following description of specific, exemplary embodiments in conjunction with the accompanying figures. While features may be discussed relative to certain embodiments and figures below, all embodiments can include one or more of the advantageous features discussed herein. In other words, while one or more embodiments may be discussed as having certain advantageous features, one or more of such features may also be used in accordance with the various embodiments discussed herein. In similar fashion, while exemplary embodiments may be discussed below as device, system, or method embodiments it should be understood that such exemplary embodiments can be implemented in various devices, systems, and methods.

BRIEF DESCRIPTION OF THE DRAWINGS

FIGS. 1A-1F are example diagrams illustrating various components of a portable storage container unit, according to some aspects.

DETAILED DESCRIPTION

Figure 2:
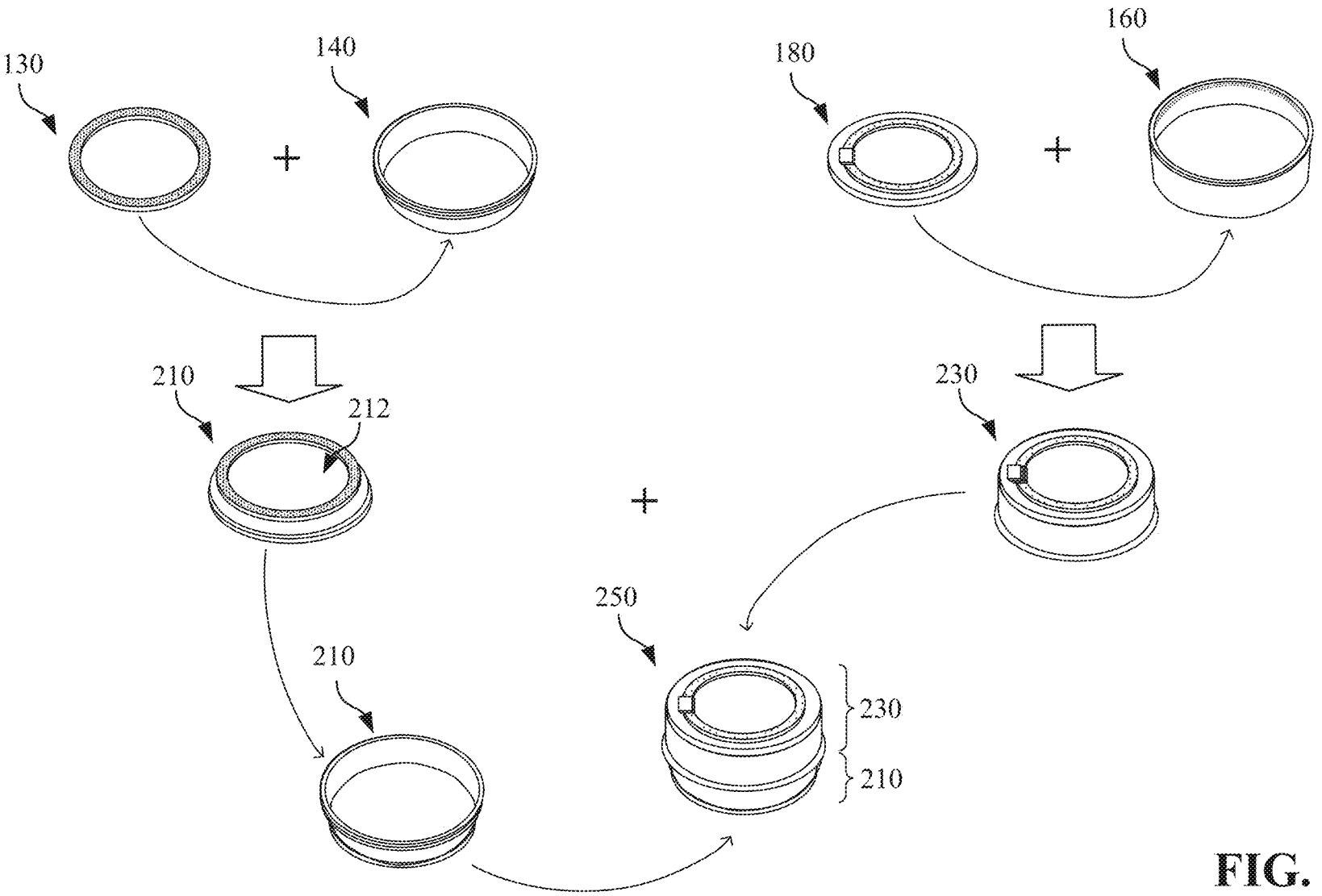
FIG. 2 is an example diagram illustrating various components of the portable storage container being assembled together, according to some aspects

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

While aspects and embodiments are described in this application by illustration to some examples, those skilled in the art will understand that additional implementations and use cases may come about in many different arrangements and scenarios.

A portable storage container should be easy to carry, to motivate a user to carry the portable storage container. Further, because people generally carry a few items at a time, such as keys, a wallet, a mobile phone, etc., it is desired to reduce a number of items to carry. In an example, in some cases, a mobile phone case is designed as a storage container to hold credit cards, so that a user who usually carries a mobile phone with the phone case can also carry the credit cards along with the mobile phone. To carry personal items such as pills, medications, mints, candies and keys, a portable storage container that is easy to carry and not cumbersome is desirable. Some items, such as required medications, are important items that a user cannot forget. Hence, a portable storage container that can be carried along with a portable item such as a mobile phone that a user always carries may also be desirable. Further, it may be desirable for the portable storage to be easily attachable to and detachable from the portable item, for flexibility and ease of use.

According to some aspects of the disclosure, a portable storage container is provided. The portable storage container includes an engaging component configured to detachably engage with a coupling component coupled to a portable item and a storage component attached to the engaging component. The storage component includes a first storage component part with the engaging component attached to one side of the first storage component part, the first storage component part being configured to be detachably coupled to the coupling component via the engaging component, and further includes a second storage component part configured to detachably couple to the first storage component part. The first storage component part and/or the second storage component part may have a storage space, which may be used to store personal items such as pills, medications, mints, candies, and keys. In some aspects, a portable storage container unit may include the portable storage container described above and the coupling component configured to be coupled to the portable item as described above.

In some aspects, a shape of an engaging portion of the engaging component configured to couple to the coupling component may correspond to a shape of the coupling component to prevent a lateral movement when the engaging component is coupled to the coupling component. In some aspects, the engaging portion of engaging component may be a recess configured to receive a protruded portion of the coupling component. In some aspects, a shape of a lateral cross-section of the engaging portion of the engagement component may be substantially same as a shape of a lateral cross-section of the protruded portion of the coupling component.

In some aspects, the portable storage container may further include an accessory component attached to the second storage component part, where the accessory component may include at least one of a holder for the portable item or a stand for the portable item. In some aspects, the coupling component may be coupled to the portable item via adhesive. For example, as the accessory component, an ergonomic ring holder may be implemented to provide ease of manipulation of the mobile device. Further, in some examples, the implementation of the ring holder may provide a space to implement the portable storage container as a part of a structure of the ring holder.

In some aspects, the coupling component may include a magnet, and at least one of the engaging component or the first storage component part may include at least one magnet or a ferromagnetic material to detachably engage with the coupling component via magnetic force of the magnet. In some aspects, the coupling component may include at least one of a magnet or a ferromagnetic material, and at least one of the engaging component or the first storage component part may include at least one magnet to detachably engage with the coupling component via magnetic force of the at least one magnet. In some aspects, at least one of the engaging component or the first storage component part may include a magnet and the coupling component may include at least one of a magnet or a ferromagnetic material to detachably engage with the coupling component via magnetic force of the magnet.

In some aspects, the first storage component part may include a threaded recess portion that is threaded with a third thread and the coupling component may include a threaded protrusion portion that is threaded with a fourth thread that corresponds to the third thread to enable the first storage component part and the coupling component to be screwed together via the threaded recess portion and the threaded protrusion portion.

In some aspects, the coupling component may include one or more lock components that fit into one or more lock grooves of the first storage component part, where the first storage component part is rotated in one direction to lock the first storage component part and the coupling component in an engaged state and is rotated in another direction to unlock the first storage component part and the coupling component to detach the first storage component part from the coupling component.

When the first storage component part and/or the engaging component attached to the first storage component part include a magnet, the storage component may be separately stored and arranged on a magnetic surface such as a refrigerator. In one use example, seven storage components respectively containing medications for seven days of a week may be magnetically attached to a refrigerator, so that a user may take a storage component each day of the week from the refrigerator for ease of use. In some aspects, the engaging component may be shaped with a recess such that the magnet may be snugly inserted into the recess of the engaging component. As such, the magnetic force may prevent vertical movements (e.g., movements substantially perpendicular to a surface of the magnet) of the magnet with respect to the engaging component while the recess of the engaging component may prevent lateral movements (e.g., movements substantially parallel to the surface of the magnet) of the magnet with respect to the engaging component.

The vertical movements and/or the lateral movements may be caused by various factors such as gravity and frictions (e.g., frictional forces during movement in a pocket or a purse where the mobile device with the storage component attached thereto is stored. Hence, such a structure of the engaging component and the magnet provides benefits in that it allows a thinner coupling mechanism due to the applied magnetic force.

In some aspects, the first storage container may be threaded with a first thread and the second storage container may be threaded with a second thread that corresponds to the first thread to enable the first storage container and the second storage container to be screwed together.

By providing a portable storage container that can be securely attached to and detached from a portable item such as a mobile device (e.g., mobile phone), a user may be able to conveniently access his/her personal items stored in the portable storage container any time. Hence, one of the benefits of this portable storage container is improved availability of the personal items when the user needs them. For example, pills or medications may be stored and carried in the portable storage container attached to a mobile device that is almost always with the user, which may improve adherence to medications with this improved availability. While people may often forget to take a traditional pill box or a medication case with them, they may almost always have their portable items (e.g., mobile phones, tablets, laptops, wallets, etc.), especially when they leave home or are on the go. In another example, keys may be stored and carried in the portable storage container attached to a mobile device. As the keys are stored in the portable storage container, the keys may not scratch other items in a pocket or a purse. For example, when carrying the keys and the mobile device in the same pocket or in the same purse, by storing the keys in the portable storage attached to the mobile device, the keys may not scratch the display screen of the mobile device. Because the portable storage container may be attached to the portable item that is carried by the user, this provides a way for the user to conveniently access the personal items such as pills or medications or keys whenever the user needs them. When not in use, the mobile device may retain a slim form factor.

FIGS. 1A-1F are example diagrams illustrating various components of a portable storage container unit, according to some aspects. In particular, FIG. 1A shows an example drawing of an attachment component 110. FIG. 1B shows an example drawing of a coupling component 120.

FIGS. 1C-IF show various components of a portable storage container of the portable storage container unit, according to some aspects. FIG. 1C shows an example drawing of an engaging component 130. FIG. 1D shows an example drawing of a first storage component part 140. FIG. 1D shows a first view 142 of the first storage component part 140 showing a hollow recess 148 that can be used as a storage space and a second view 144 showing the first storage component part 140 flipped over from the first view 142. FIG. 1E shows an example drawing of a second storage component part 160. FIG. 1E shows a first view 162 of the second storage component part 160 showing a hollow recess 168 that can be used as a storage space and a second view 164 showing the second storage component part 160 flipped over from the first view 162. In an example, the first storage component part 140 may be a cap for the second storage component part 160, and the second storage component part 160 may provide a main storage space for the personal items. In another example, the second storage component part 160 may be a cap for the first storage component part 140, and the first storage component part 140 may provide a main storage space for the personal items FIG. 1F shows an example drawing of an accessory component 180. These components are explained in more in detail below, with reference to the example drawings of these components.

The portable storage container includes the engaging component 130 configured to detachably engage with the coupling component 120 coupled to a portable item, and further includes a storage component including the first storage component part 140 and the second storage component part 160. When assembled, the engaging component 130 is attached one side of the first storage component part 140, where the first storage component part 140 is configured to be detachably coupled to the coupling component 120 via the engaging component 130. The second storage component part 150 is configured to detachably couple to the first storage component part 140. Assembly of the engaging component 130 and the storage component including the first storage component part 140 and the second storage component part 160 to form the portable storage container is illustrated below in FIG. 2. The portable storage unit includes the coupling component 120 and the portable storage container.

The coupling component 120 may be coupled to a portable item, such as a mobile phone, a tablet, a laptop, a notebook, etc., to stay attached to the portable item. The attachment component 110 may be an optional component. In some aspects, the attachment component 110 may be an adhesive component that can be used to attach the coupling component 120 to a portable item. For example, the attachment component 110 may include a tape or other types of adhesive to attach the coupling component 120 to a portable item. In one example, the attachment component 110 may be a double-sided tape. In another example, the attachment component 110 may include a mechanical locking mechanism or screws to attach the coupling component 120 to the portable item. In another aspect, the coupling component 120 may be attached to the portable item without the attachment component 110. For example, the coupling component 120 may be attached to the portable item via any available means, such as, glue or adhesive, or may be screwed into the portable item. In another example, the coupling component 120 may be a part of a case for a portable item.

The engaging component 130 may be configured to be detachably engage with the coupling component 120. In some aspects, a shape of the engaging component corresponds to a shape of the coupling component to prevent a lateral movement when the engaging component 130 is coupled to the coupling component 120.

As discussed above, the storage component includes a first storage component part 140 and a second storage component part 160 that are configured to be detachably coupled to each other. The first storage component part 140 and/or the second storage component part 160 may include a storage space to store personal items.

In some aspects, the first storage component part 140 may be threaded with a first thread 146 and the second storage component part 160 may be threaded with a second thread 166, such that the first storage component part 140 and the second storage component part 160 may be coupled to each other by screwing them together via the first thread 146 and the second thread 166 that corresponds to the first thread 146, and may be detached from each other by unscrewing. For example, the first thread 146 may be present on an exterior of the first storage component part 140 and the second thread 166 may be present on an interior of the second storage component part 160. It is noted that a mechanism to detachably couple the first storage component part 140 and the second storage component part 160 is not limited to the threads explained above. In another example, the first storage component part 140 may snugly fit on the second storage component part 160 so that a user may securely place the first storage component part 140 together with the second storage component part 160 and may detach them from each other by pulling the first storage component part 140 together with the second storage component part 160 apart.

In some aspects, the coupling component 120 may include a magnet, and at least one of the engaging component 130 or the first storage component part 140 may include at least one magnet or a ferromagnetic material to detachably engage with the coupling component 120 via magnetic force. In some aspects, at least one of the engaging component 130 or the first storage component part 140 may include a magnet and the coupling component 120 may include at least one of a magnet or a ferromagnetic material to detachably engage with the coupling component 120 via magnetic force.

In some aspects, the engaging component 130 may be attached to one side 149 of the first storage component part 140. For example, the engaging component 130 may be attached to one side 149 of the first storage component part 140 via any available means, such as, glue or adhesive, or may be screwed into one side 149 of the first storage component part 140. The first storage component part 140 may be detachably coupled to the coupling component 120 with the engaging component 130 engaging with the coupling component 120.

An accessory component is an optional component for the portable storage container. In some aspects, an accessory component 180 may be attached to one side 169 of the second storage component part 160, where the accessory component 180 may include a ring holder 182. For example, the accessory component 180 may be attached to one side 169 of the second storage component part 160 via any available means, such as, glue or adhesive, or may be screwed into one side of the second storage component part 160. In an example, when attached to the second storage component part 160, the accessory component 180 may be rotatable with respect to the second storage component part 160. In some aspects, the accessor component 180 may be integrally formed with the second storage component part 160, as a part of the second storage component part 160. Although FIG. 1F shows the ring holder 182 as the accessor component 180, the accessory component is not limited to the ring holder, but may include a different structure or a design, such as a stand (e.g., kickstand) for the portable item. The accessory component 180 may be an optional component of the portable storage device.

FIG. 2 is an example diagram illustrating various components of the portable storage container being assembled together, according to some aspects. In particular, FIG. 2 shows assembly of the engaging component 130, the first storage component part 150, the second storage component part 160, and the accessory component 180 of the storage container of FIG. 1. As discussed above, the accessory component 180 is an optional feature of the storage container, and thus may be omitted in some embodiments. As shown in FIG. 2, the engaging component 130 may be attached to one side of the first storage component part 140 to provide a first storage component assembly 210. With this arrangement, the engagement component 130 together with the first storage component part 140 may form a recess 212 as an engaging portion where a protruded portion of the coupling assembly 120 may be inserted. Further, as shown in FIG. 2, the accessory component 180 may be attached to one side of the second storage component part 160 to provide a second storage component assembly 230. The first storage component assembly 210 and the second storage component assembly 230 may be detachably attached to each other to form a portable storage container 250. For example, as explained above, the second storage component assembly 230 via the second thread 166 of the second storage component part 160 can be screwed on the first storage component assembly 210 via the first thread 146 of the first storage component part 140. In this example, to open the portable storage container 250, the second storage component assembly 230 may be unscrewed from the first storage component assembly 210.

Figure 3B:
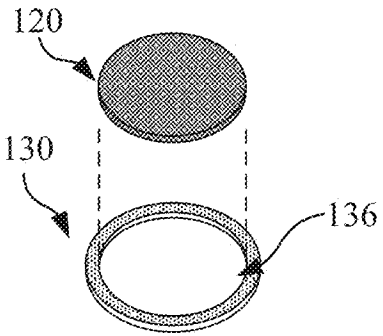
FIG. 3B is an example diagram illustrating matching shapes of the coupling component and the engaging component, according to some aspects.
Figure 3A:
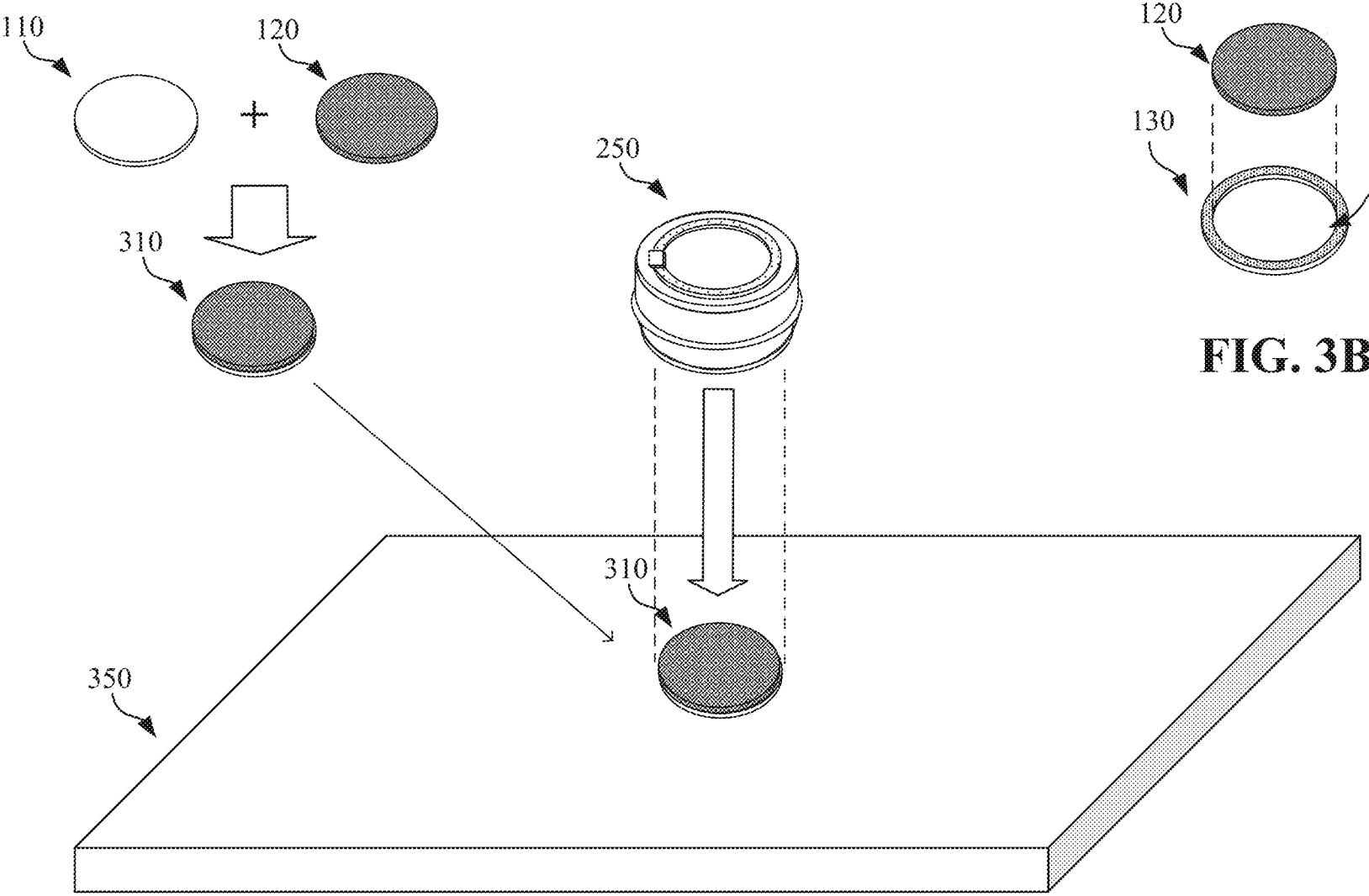
FIG. 3A is an example diagram illustrating a portable storage container that can be detachably coupled to a coupling component, according to some aspects.

FIG. 3A is an example diagram illustrating a portable storage container that can be detachably coupled to a coupling component, according to some aspects. As shown in FIG. 3A, the coupling component 120 may be attached to the attachment component 110 to form a coupling assembly 310, and the coupling assembly 310 may be attached to a portable item 350 via the coupling component 120. As discussed above, in an example, the attachment component 110 may be a double-sided tape. In an example, the portable item 350 may be a mobile phone.

FIG. 3B is an example diagram illustrating matching shapes of the coupling component and the engaging component, according to some aspects. As shown in FIG. 3B, a shape of an engaging portion 136 of the engaging component 130 configured to couple to the engaging component 130 may correspond to a shape of the coupling component 120 to prevent a lateral movement when the engagement component 130 is coupled to the coupling component 120. For example, when the portable storage container 250 is coupled to the coupling component 120 as shown in FIG. 3A, the coupling component 120 may be inserted into the engaging portion 136 of the engaging component 130. In particular, the engaging portion 136 of the engaging component 130 is a recess configured to receive a protruded portion of the coupling component 120, where the circular shape of the protruded portion of the coupling component 120 may correspond to the circular shape of the engaging portion 136 that is a circular recess. For example, a shape of a lateral cross-section of the engaging portion 136 of the engagement component is a circle having a substantially same shape as a shape of a lateral cross-section of the protruded portion of the coupling component 120. Although the shape of the coupling component 120 and the shape of the engaging portion 136 of the engaging component 130 shown in FIGS. 1-3 are circular, in a different example not shown in these figures, the shape of the coupling component 120 and the shape of the engaging portion 136 of the engaging component 130 may be a shape other than a circular shape. For example, in another aspect, a shape of a coupling component and a shape of an engaging portion of the engaging component may be a square shape or a star shape.

Figure 4B:
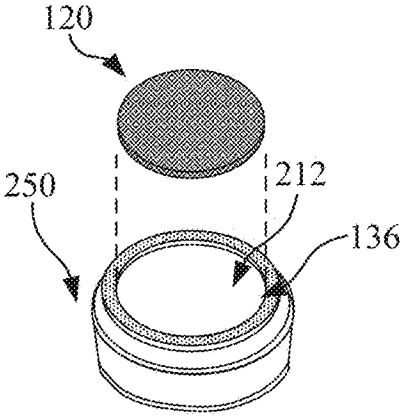
FIG. 4B is an example diagram showing the engaging component of the storage component assembly may be coupled to the coupling component, according to some aspects.
Figure 4A:
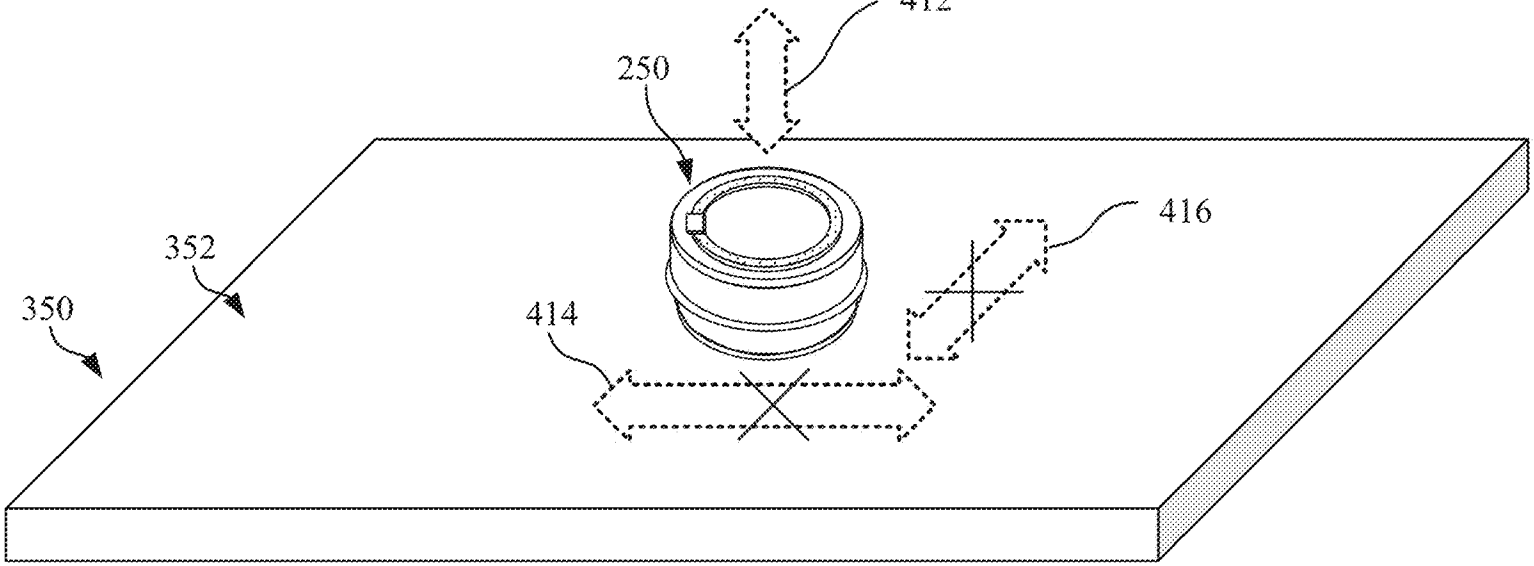
FIG. 4A is an example diagram illustrating the portable storage container detachably coupled to the coupling component attached to the portable item, according to some aspects.

FIG. 4A is an example diagram illustrating the portable storage container detachably coupled to the coupling component attached to the portable item, according to some aspects. FIG. 4B is an example diagram showing the engaging component of the storage component assembly may be coupled to the coupling component, according to some aspects. Because the shape of an engaging portion of the engaging component 130 that couples to the coupling component 120 corresponds to the shape of the coupling component 120, a lateral movement of the portable storage container 250 is prevented or minimized when the engaging component 130 is coupled to the coupling component 120. For example, as shown in FIG. 4A, when the portable storage container 250 is coupled to the coupling component 120 (not shown in FIG. 4A, as shown in FIG. 3A), the engaging portion 136 of the engaging component 130 forms the recess 212 where the coupling assembly 120 may be inserted, which prevents movements of the portable storage container 250 in lateral directions 414 and 416, while allowing movements in a vertical direction 412 (with respect to the surface 352 of the portable item 350) when the portable storage container 250 is decoupled from the coupling component 120.

In some aspects, the portable storage container may be detachably coupled to the coupling component via magnetic force between the coupling component 120 and the engaging component 130. In one example, the coupling component 120 may include a magnet and the engaging component 130 may also include a magnet, so that the coupling component 120 and the engaging component 130 may be detachably coupled together via magnetic force of the two magnets. In another example, the engaging component 130 may include a magnet and the coupling component 120 may include a ferromagnetic material, so that the coupling component 120 and the engaging component 130 may be detachably coupled together via magnetic force of the magnet in the engaging component 130 attracting the ferromagnetic material of the coupling component 120. In another example, the coupling component 120 may include a magnet and the engaging component 130 may include a ferromagnetic material, so that the coupling component 120 and the engaging component 130 may be detachably coupled together via magnetic force of the magnet in the coupling component 120 attracting the ferromagnetic material of the coupling component 130. The magnetic force as well as the shapes of the coupling component 120 and the engaging component 130 may keep the portable storage container 250 to stay coupled to the coupling component 120 on the portable item 350, while the portable storage container 250 may be detached from the coupling component 120 on the portable item 350 by applying a pulling force in the vertical direction 412 perpendicular to the surface 352 of the portable item 350, to allow the user to conveniently remove the portable storage container 250.

Figure 5:
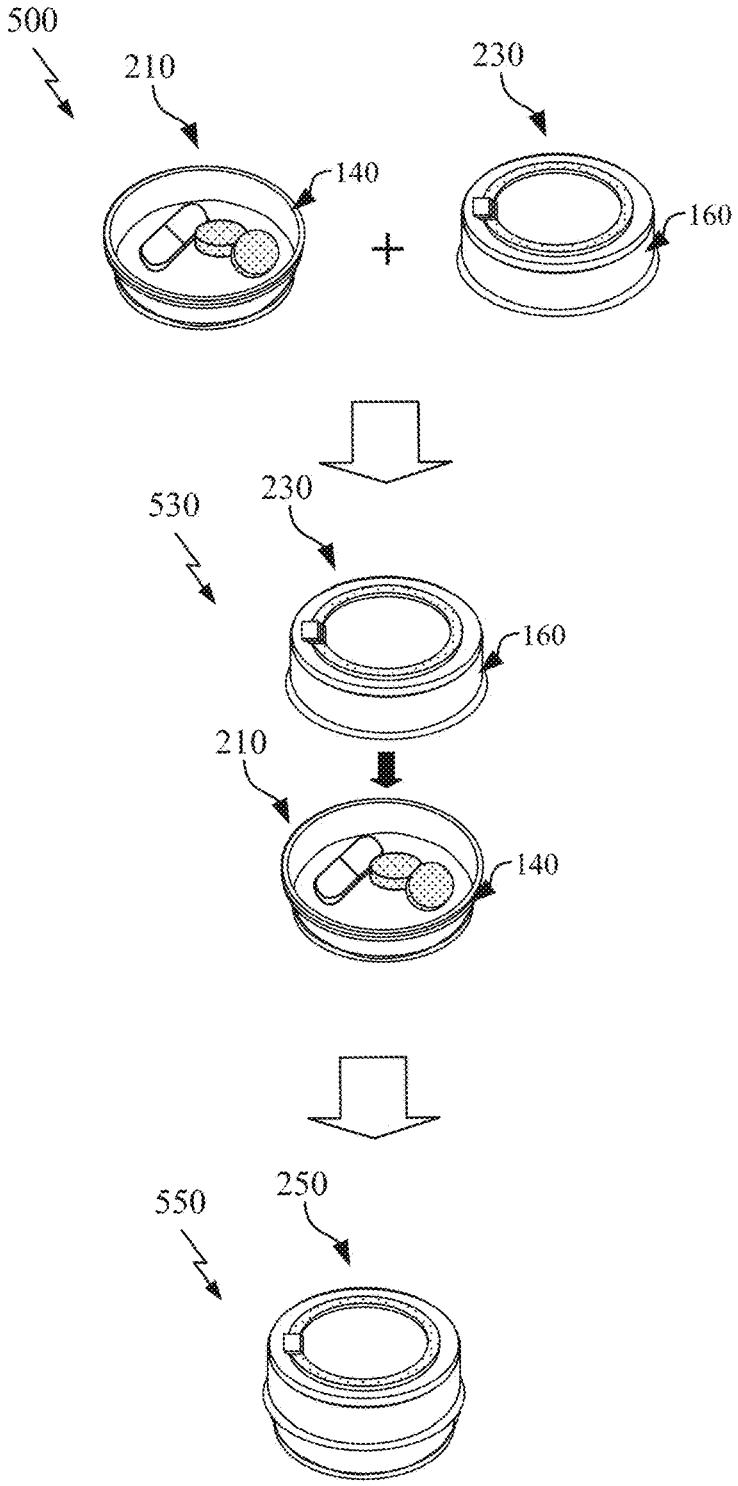
FIG. 5 shows example diagrams illustrating use of the portable storage container to carry personal items, according to some aspects.

FIG. 5 shows example diagrams illustrating use of the portable storage container to carry personal items, according to some aspects. In a first diagram 500 of FIG. 5, the user places pills inside the first storage component part 140 of the first storage component assembly 210. Subsequently, in the second diagram 530 of FIG. 5, the second storage component part 160 of the second storage component assembly 230 is placed over the first storage component part 140 of the first storage component assembly 210, with the pills inside the first storage component part 140. Then, in the third diagram 550 of FIG. 5, the user may rotate the second storage component part 160 with respect to the first storage component part 140 to screw them together, to securely couple the second storage component part 160 on the first storage component part 140.

Figure 6C:
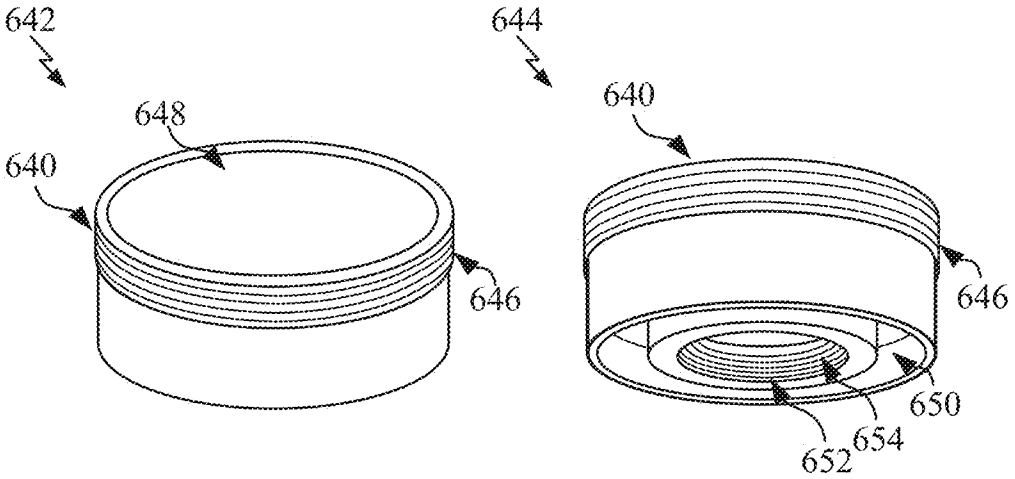
FIGS. 6A-6E are example diagrams illustrating various components of a portable storage container unit, according to some aspects.
Figure 6D:
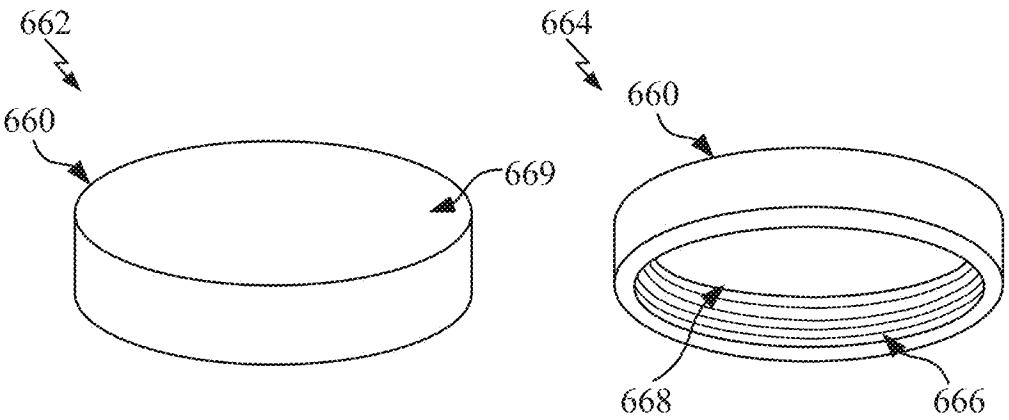
Figure 6A:
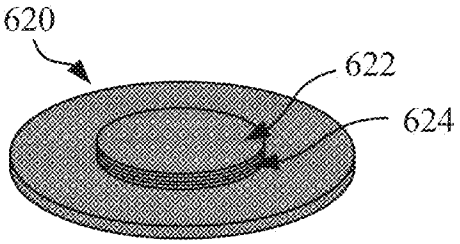

FIGS. 6A-6E are example diagrams illustrating various components of a portable storage container unit, according to some aspects. In particular, FIG. 6A shows an example drawing of a coupling component 620.

Figure 6B:
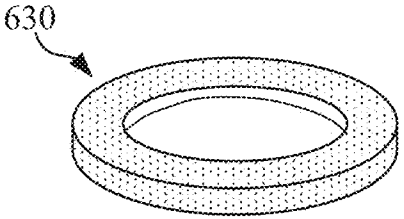
Figure 6E:
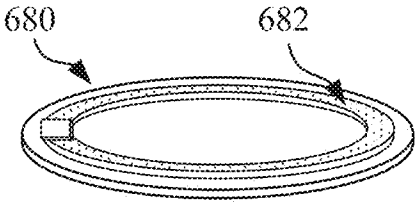

FIGS. 6B-6E show various components of a portable storage container of the portable storage container unit, according to some aspects. FIG. 6B shows an example drawing of an engaging component 630. FIG. 6C shows an example drawing of a first storage component part 640. FIG. 6C shows a first view 642 of the first storage component part 640 showing a hollow recess 648 that can be used as a storage space and a second view 644 showing the other end (e.g., bottom side) the first storage component part. FIG. 6D shows an example drawing of a second storage component part 660. FIG. 6D shows a first view 662 showing a top surface 669 of the second storage component part and a second view 664 of the second storage component part 660 showing a hollow recess 668 on the other side. In an example, the second storage component part 660 may be a cap for the first storage component part 640, and the first storage component part 640 may provide a main storage space for the personal items FIG. 6E shows an example drawing of an accessory component 680. These components are explained in more in detail below, with reference to the example drawings of these components.

The portable storage container includes the engaging component 630 configured to detachably engage with the coupling component 620 coupled to a portable item, and further includes a storage component including the first storage component part 640 and the second storage component part 660. When assembled, the engaging component 630 is attached one side (e.g., bottom side) of the first storage component part 640, where the first storage component part 640 is configured to be detachably coupled to the coupling component 620 via the engaging component 630. In particular, as shown in FIG. 6C, the first storage component part 640 includes an engaging component receiving channel 650 into which the engaging component 630 can be inserted. For example, the engaging component 630 may be attached to the engaging component receiving channel 650 via any available means, such as, glue or adhesive, or may be screwed into the engaging component receiving channel 650, or may be snugly fit into the engaging component receiving channel 650, such that the engaging component 630 will not be easily separated from the engaging component receiving channel 650.

The second storage component part 650 is configured to detachably couple to the first storage component part 640. Assembly of the engaging component 630 and the storage component including the first storage component part 640 and the second storage component part 660 to form the portable storage container is illustrated below in FIG. 7. The portable storage unit includes the coupling component 620 and the portable storage container.

The coupling component 620 may be coupled to a portable item, such as a mobile phone, a tablet, a laptop, a notebook, etc., to stay attached to the portable item. In an example, adhesives or a tape (e.g., double-sided tape) may be used to attach the coupling component 620 to a portable item. In another example, a mechanical locking mechanism or screws may be used to attach the coupling component 620 to the portable item. In another example, the coupling component 620 may be a part of a case for the portable item.

In some aspects, the coupling component 620 may include a magnet, and at least one of the engaging component 630 or the first storage component part 640 may include at least one magnet or a ferromagnetic material to detachably engage with the coupling component 620 via magnetic force. In some aspects, at least one of the engaging component 630 or the first storage component part 640 may include a magnet and the coupling component 620 may include at least one of a magnet or a ferromagnetic material to detachably engage with the coupling component 620 via magnetic force.

The coupling component 620 may have an engaging protrusion 622 to engage with an engaging recess 652 of the first storage component part 640. In some aspects, a shape of the engaging recess 652 may correspond to a shape of the engaging protrusion 622 of the coupling component 620 to prevent a lateral movement when the engaging protrusion 622 of the coupling component 620 is inserted into the engaging recess 652 of the first storage component part 640.

In some aspects, optionally, the engaging recess 652 of the first storage component part 640 may include a third thread 654 and the engaging protrusion 622 of the coupling component 620 may include a fourth thread 624 that corresponds to the third thread 654 to enable the first storage component part 640 and the coupling component 620 to be screwed together. In this aspect, the third thread 654 and the fourth thread 624 in addition to the engaging component 630 (e.g., utilizing the magnetic force) may allow even more secure engagement between the first storage component part 640 and the coupling component 620. It is noted that the third thread 654 and the fourth thread 624 are optional components and may not be present in some embodiments. In some aspects, instead of the third thread 654 and the fourth thread 624, a latch mechanism may be used.

As discussed above, the storage component includes a first storage component part 640 and a second storage component part 660 that are configured to be detachably coupled to each other. The first storage component part 640 and/or the second storage component part 660 may include a storage space to store personal items.

In some aspects, the first storage component part 640 may be threaded with a first thread 646 and the second storage component part 660 may be threaded with a second thread 666, such that the first storage component part 640 and the second storage component part 660 may be coupled to each other by screwing them together via the first thread 646 and the second thread 666 that corresponds to the first thread 646, and may be detached from each other by unscrewing. For example, the first thread 646 may be present on an exterior of the first storage component part 640 and the second thread 666 may be present on an interior of the second storage component part 660. It is noted that a mechanism to detachably couple the first storage component part 640 and the second storage component part 660 is not limited to the threads explained above. In another example, the first storage component part 640 may snugly fit on the second storage component part 660 so that a user may securely place the first storage component part 640 together with the second storage component part 660 and may detach them from each other by pulling the first storage component part 640 together with the second storage component part 660 apart.

An accessory component is an optional component for the portable storage container. In some aspects, an accessory component 680 may be attached to one side 669 of the second storage component part 660, where the accessory component 680 may include a ring holder 682. For example, the accessory component 680 may be attached to one side 669 of the second storage component part 660 via any available means, such as, glue or adhesive, or may be screwed into one side of the second storage component part 660. In an example, when attached to the second storage component part 660, the accessory component 680 may be rotatable with respect to the second storage component part 660. In some aspects, the accessor component 680 may be integrally formed with the second storage component part 660, as a part of the second storage component part 660. Although FIG. 6E shows the ring holder 682 as the accessor component 680, the accessory component is not limited to the ring holder, but may include a different structure or a design, such as a stand (e.g., kickstand) for the portable item. The accessory component 680 may be an optional component of the portable storage device.

Figure 7A:
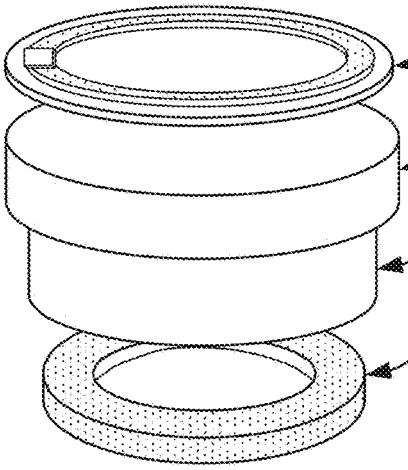
FIG. 7A is an example diagram illustrating various components of the portable storage container prior to assembly, according to some aspects.
Figure 7B:
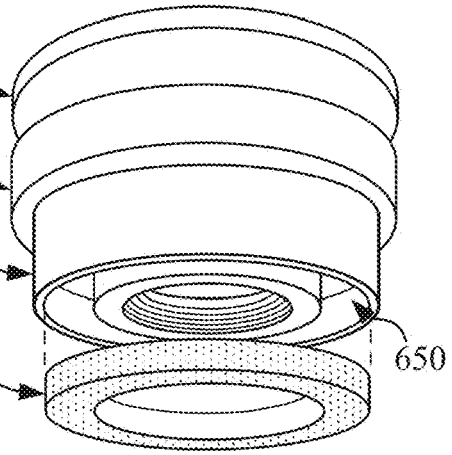
FIG. 7B is an example diagram illustrating the components of the portable storage container of FIG. 7A shown in a different angle, according to some aspects.
Figure 7C:
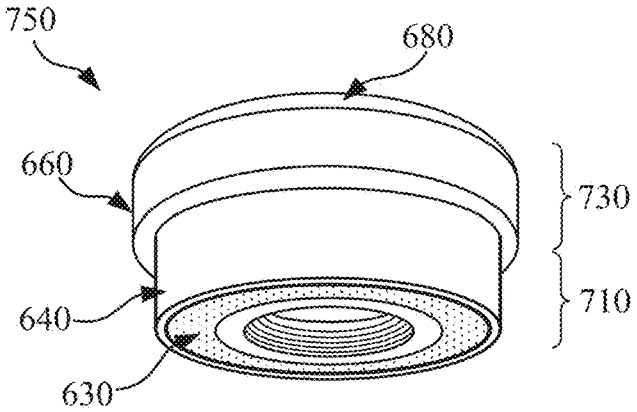
FIG. 7C is an example diagram of the components of FIGS. 7A and 7B assembled together to form the portable storage container, according to some aspects.

FIGS. 7A-7D are example diagrams illustrating various components of the portable storage container being assembled together, according to some aspects. FIG. 7A is an example diagram illustrating various components of the portable storage container prior to assembly, according to some aspects. FIG. 7B is an example diagram illustrating the components of the portable storage container of FIG. 7A shown in a different angle, according to some aspects. Further, FIG. 7C is an example diagram of the components of FIGS. 7A and 7B assembled together to form the portable storage container, according to some aspects.

In particular, FIGS. 7A and 7B show how assembly of the engaging component 630, the first storage component part 650, the second storage component part 660, and the accessory component 680 of the storage container of FIG. 6. As discussed above, the accessory component 680 is an optional feature of the storage container, and thus may be omitted in some embodiments. As shown in FIGS. 7A, 7B, and 7C, the engaging component 630 may be inserted into the engaging component receiving channel 650 of the first storage component part 640 to provide a first storage component assembly 710. Further, as shown in FIGS. 7A, 7B, and 7C, the accessory component 680 may be attached to one side of the second storage component part 660 to provide a second storage component assembly 730. As shown in FIG. 7C, the first storage component assembly 710 and the second storage component assembly 730 may be detachably attached to each other to form a portable storage container 750. For example, as explained above, the second storage component assembly 730 via the second thread 666 of the second storage component part 660 can be screwed on the first storage component assembly 710 via the first thread 646 of the first storage component part 640.

Figure 7D:
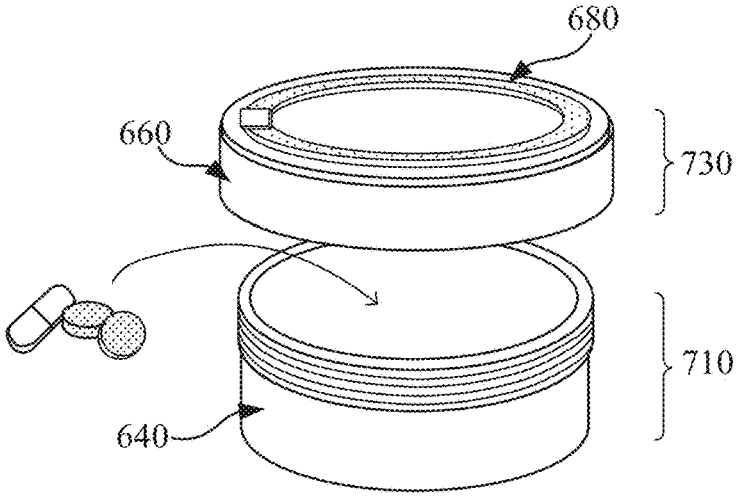
FIG. 7D is an example diagram showing the second storage component assembly being separated from the first storage component assembly of the portable storage container, according to some aspects.

FIG. 7D is an example diagram showing the second storage component assembly being separated from the first storage component assembly of the portable storage container, according to some aspects. As shown in FIG. 7D, to open the portable storage container 750, the second storage component assembly 730 may be unscrewed from the first storage component assembly 710. Personal items such as pills may be placed into the first storage component part 640.

Figure 8A:
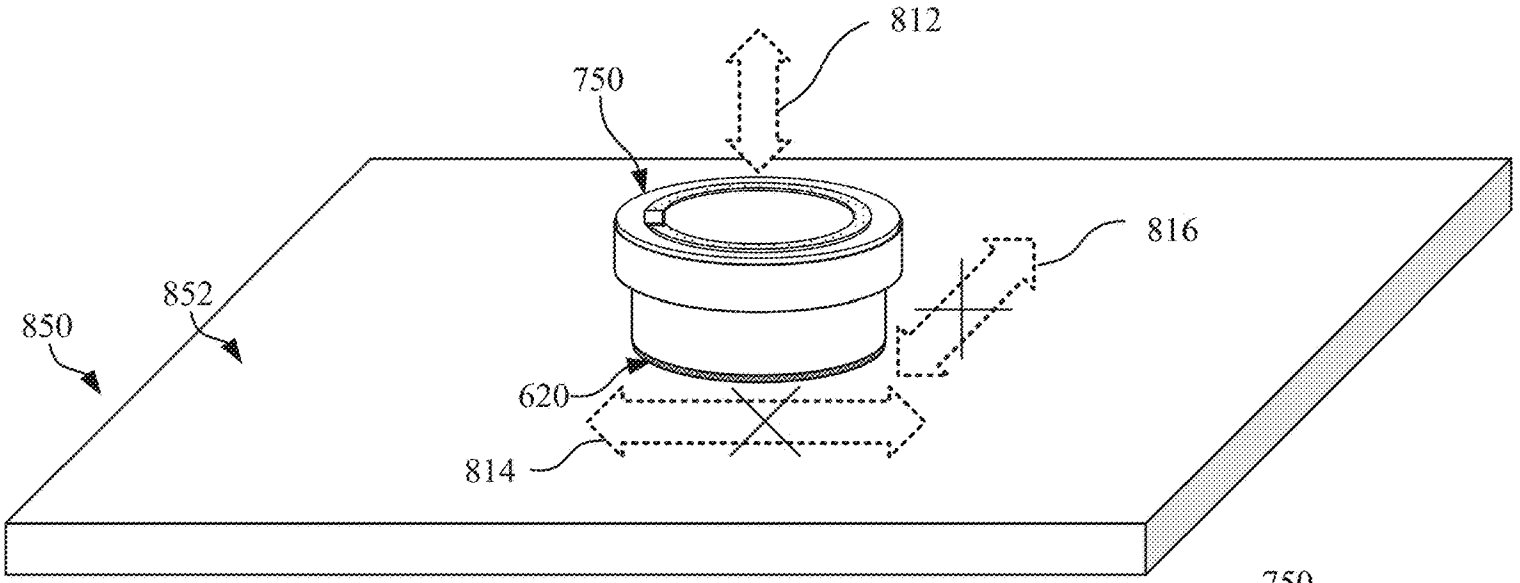
FIG. 8A is an example diagram illustrating the portable storage container detachably coupled to the coupling component attached to the portable item, according to some aspects.
Figure 8B:
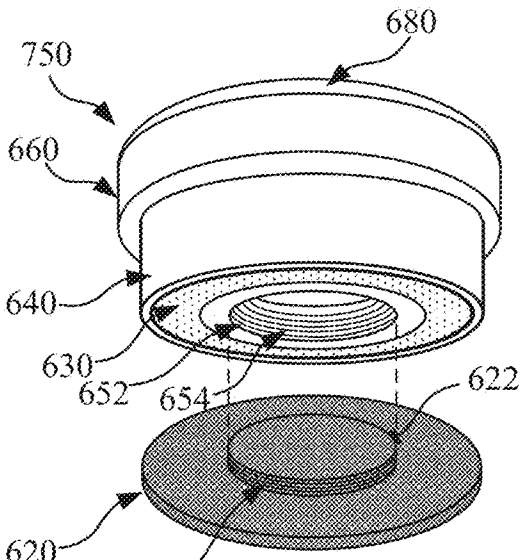
FIG. 8B is an example diagram showing the portable storage container to be coupled to the coupling component, according to some aspects.

FIG. 8A is an example diagram illustrating the portable storage container detachably coupled to the coupling component attached to the portable item, according to some aspects. FIG. 8B is an example diagram showing the portable storage container to be coupled to the coupling component, according to some aspects. Because the shape of the engaging recess 652 of the first storage component part 640 that couples to the coupling component 620 corresponds to the shape of the coupling component 620, a lateral movement of the portable storage container 750 is prevented or minimized when the engaging recess 652 is coupled to the coupling component 620. For example, as shown in FIG. 8A, when the engaging recess 652 of the first storage component part 640 is coupled to the coupling component 620, this prevents movements of the portable storage container 750 in lateral directions 814 and 816. Movements in a vertical direction 812 (with respect to the surface 852 of the portable item 850) may be allowed when the portable storage container 750 is decoupled from the coupling component 620.

In some aspects, the portable storage container may be detachably coupled to the coupling component via magnetic force between the coupling component 620 and the engaging component 630. In one example, the coupling component 620 may include a magnet and the engaging component 630 may also include a magnet, so that the coupling component 620 and the engaging component 630 may be detachably coupled together via magnetic force of the two magnets. In another example, the engaging component 630 may include a magnet and the coupling component 620 may include a ferromagnetic material, so that the coupling component 620 and the engaging component 630 may be detachably coupled together via magnetic force of the magnet in the engaging component 630 attracting the ferromagnetic material of the coupling component 620. In another example, the coupling component 620 may include a magnet and the engaging component 630 may include a ferromagnetic material, so that the coupling component 620 and the engaging component 630 may be detachably coupled together via magnetic force of the magnet in the coupling component 620 attracting the ferromagnetic material of the coupling component 630. The magnetic force as well as the shapes of the coupling component 620 and the engaging component 630 may keep the portable storage container 750 to stay coupled to the coupling component 620 on the portable item 850, while the portable storage container 750 may be detached from the coupling component 620 on the portable item 850 by applying a pulling force in the vertical direction 812 perpendicular to the surface 852 of the portable item 850, to allow the user to conveniently remove the portable storage container 750.

In some aspects, as shown in FIG. 8B, the engaging recess 652 of the first storage component part 640 may include the third thread 654 and the engaging protrusion 622 of the coupling component 620 may include the fourth thread 624 that corresponds to the third thread 654 to enable the first storage component part 640 and the coupling component 620 to be screwed together. This mechanism may provide additional security in addition to the magnetic force discussed above when the portable storage container 750 is engaged with the coupling component 620.

In another embodiment, instead of having threads in the first storage component part and the coupling component, a twist-lock mechanism may be implemented to detachably engage the first storage component part to the coupling component. For example, the coupling component may include lock components that respectively fit into lock grooves of the first storage component part, where the first storage component part is rotated in one direction to lock the first storage component part and the coupling component in an engaged state and is rotated in another direction to unlock the first storage component part and the coupling component to detach the first storage component part from the coupling component. In this example, when the first storage component part is rotated, the lock components of the coupling component may move along a locking path within the first storage component part to lock the first storage component part and the coupling component in the engaged state.

Figure 9B:
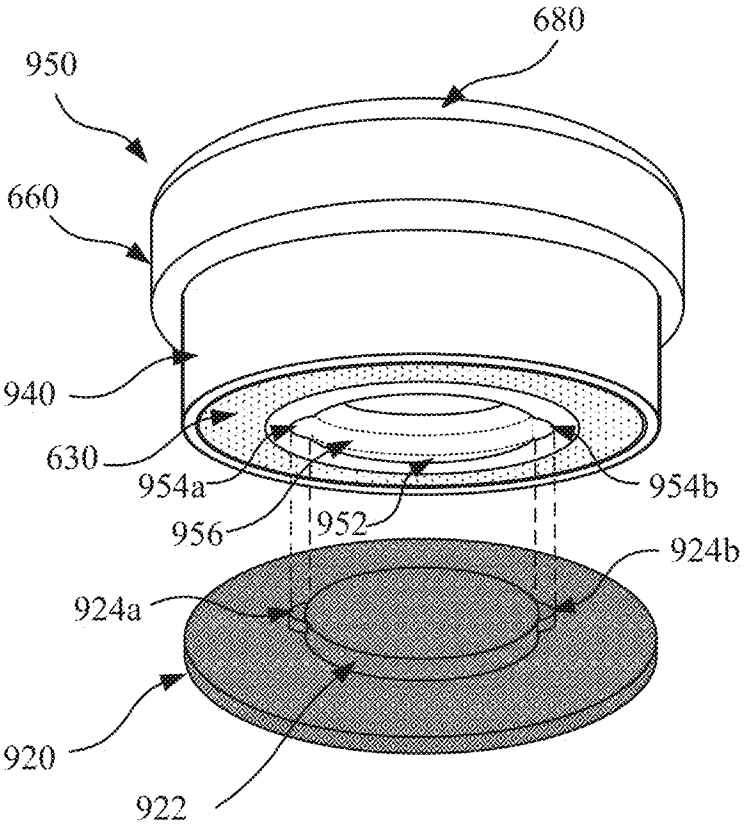
FIG. 9B is an example diagram showing the portable storage container to be coupled to the coupling component, according to some aspects.
Figure 9A:
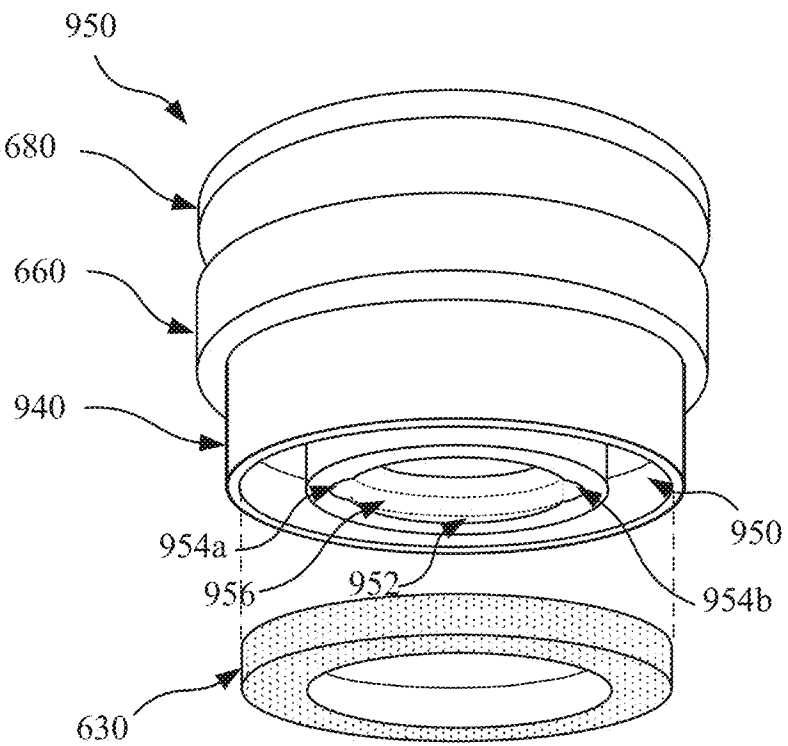
FIG. 9A is an example diagram illustrating various components of the portable storage container prior to assembly, according to some aspects.

FIG. 9A is an example diagram illustrating various components of a portable storage container prior to assembly, according to some aspects. FIG. 9B is an example diagram showing the portable storage container to be coupled to the coupling component, according to some aspects. The portable storage container 950 may include the engaging component 630, the second storage component part 660, and the accessory component 680 as well as a first storage component part 940. As discussed above, the accessory component 680 may be an optional component. The engaging component 630, the second storage component part 660, and the accessory component 680 as shown in FIGS. 9A and 9B may have the same features as the engaging component 630, the second storage component part 660, and the accessory component 680 described above in reference to FIGS. 6-8, and thus explanations of the engaging component 630, the second storage component part 660, and the accessory component 680 of FIGS. 9A and 9B are omitted.

The first storage component part 940 of FIGS. 9A and 9B is similar to the first storage component part 640 of FIGS. 6-8, but is different in that first storage component part 940 has a first lock groove 954*a* and a second lock groove 954*b* as a part of an engaging recess 952 of the first storage component part 940, instead of threads. The coupling component 920 of FIG. 9B is similar to the coupling component 620 of FIGS. 6-8, but is different in that an engaging protrusion 922 of the coupling component 920 has a first lock component 924*a* and a second lock component 924*b* that respectively fit into the first lock groove 956*a* and the second lock groove 956*b* of the first storage component part 940. When the engaging protrusion 922 is inserted into the engaging recess 952 of the first storage component part 940, the first lock component 924*a* and the second lock component 924*b* are inserted into the first lock groove 954*a* and the second lock groove 954*b*, respectively. Thereafter, the first storage component part 940 may be rotated in one direction to lock the first storage component part 940 and the coupling component 920 in an engaged state, as the first lock component 924*a* and the second lock component 924*b* move along a locking path 956 within the first storage component part 940 to lock the first storage component part 940 and the coupling component 920 in the engaged state. To unlock, the first storage component part 940 may be rotated in an opposite direction so that the first lock component 924*a* and the second lock component 924*b* are moved to positions of the first lock groove 956*a* and the second lock groove 956*b*, respectively, to detach the first storage component part 940 from the coupling component 920.

The engaging component 630 may be inserted into an engaging component receiving channel 950 of the first storage component part 940. The engaging component 630 may be an optional component in this embodiment. In some aspects, the portable storage container 950 may be attracted to the coupling component 920 via magnetic force between the coupling component 920 and the engaging component 630. In one example, the coupling component 920 may include a magnet and the engaging component 630 may also include a magnet, so that the coupling component 920 and the engaging component 630 may be drawn to each other via magnetic force of the two magnets. In another example, the engaging component 630 may include a magnet and the coupling component 920 may include a ferromagnetic material, so that the coupling component 920 and the engaging component 630 may be drawn to each other via magnetic force of the magnet in the engaging component 630 attracting the ferromagnetic material of the coupling component 920. In another example, the coupling component 920 may include a magnet and the engaging component 630 may include a ferromagnetic material, so that the coupling component 920 and the engaging component 630 may be drawn to each other via magnetic force of the magnet in the coupling component 920 attracting the ferromagnetic material of the coupling component 630. The magnetic force as well as the coupling component 920 and the engaging component 630 being in the engaged state via the first lock component 924*a* and the second lock component 924*b* may keep the portable storage container 950 to stay coupled to the coupling component 920 (e.g., on a portable item).

Within the present disclosure, the word "exemplary" is used to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect coupling between two objects. For example, if object A physically touches object B, and object B touches object C, then objects A and C may still be considered coupled to one another-even if they do not directly physically touch each other. For instance, a first object may be coupled to a second object even though the first object is never directly physically in contact with the second object.

It is to be understood that the specific order or hierarchy of steps in the methods disclosed is an illustration of exemplary processes. Based upon design preferences, it is understood that the specific order or hierarchy of steps in the methods may be rearranged. The accompanying method claims present elements of the various steps in a sample order, and are not meant to be limited to the specific order or hierarchy presented unless specifically recited therein.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f) unless the element is expressly recited using the phrase "means for" or, in the case of a method claim, the element is recited using the phrase "step for."

What is claimed is:

1. A portable storage container unit, comprising:

a coupling component configured to be coupled to a portable item; and a portable storage container comprising:

an engaging component configured to detachably engage with a coupling component coupled to a portable item; and a storage component attached to the engaging component, the storage component comprising:

a first storage component part with the engaging component attached to one side of the first storage component part, the first storage component part being configured to be detachably coupled to the coupling component via the engaging component, and a second storage component part configured to detachably couple to the first storage component part, wherein:

the coupling component comprises a magnet, and at least one of the engaging component or the first storage component part comprises at least one magnet or a ferromagnetic material to detachably engage with the coupling component via magnetic force of the magnet when the engaging component contacts the coupling component, or the coupling component comprises a ferromagnetic material, and at least one of the engaging component or the first storage component part comprises the at least one magnet to detachably engage with the coupling component via magnetic force of the at least one magnet when the engaging component contacts the coupling component, and wherein a shape of an engaging portion of the engaging component configured to couple to the coupling component corresponds to a shape of the coupling component to prevent a lateral movement when the engaging component is coupled to the coupling component via the magnetic force of the magnet or the magnetic force of the at least one magnet applied in a vertical direction substantially perpendicular to the lateral movement.

2. The portable storage container unit of claim 1, wherein the engaging portion of engaging component is a recess configured to receive a protruded portion of the coupling component, and wherein, when the protruded portion of the coupling component is inserted into the recess of the engaging component and contacts the recess, the magnetic force of the magnet or the magnetic force of the at least one magnet keeps the coupling component and the engaging component engaged together, and wherein the coupling component and the engaging component engaged together via the magnetic force of the magnet or the magnetic force of the at least one magnet are disengaged when a pulling force greater than the magnetic force of the magnet or the magnetic force of the at least one magnet is applied in an opposite direction of the magnetic force of the magnet or the magnetic force of the at least one magnet.

3. The portable storage container unit of claim 2, wherein a shape of a lateral cross-section of the engaging portion of the engagement component is substantially same as a shape of a lateral cross-section of the protruded portion of the coupling component.

4. The portable storage container unit of claim 1, comprising an accessory component attached to the second storage component part, wherein the accessory component comprises at least one of a holder for the portable item or a stand for the portable item.

5. The portable storage container unit of claim 1, wherein the coupling component is configured to be coupled to the portable item via an adhesive component.

6. The portable storage container unit of claim 1, wherein the first storage component part is threaded with a first thread and the second storage component part is threaded with a second thread that corresponds to the first thread to enable the first storage container and the second storage component part to be screwed together.

7. A portable storage container unit, comprising:

a coupling component configured to be coupled to a portable item; and a portable storage container comprising:

an engaging component configured to detachably engage with the coupling component; and a storage component attached to the engaging component, the storage component comprising:

a first storage component part with the engaging component attached to one side of the first storage component part, the first storage component part being configured to detachably coupled to the coupling component via the engaging component, and a second storage component part configured to detachably couple to the first storage component part, wherein the engaging component comprises a magnet and the coupling component comprises at least one magnet or a ferromagnetic material to detachably engage with the engaging component via magnetic force of the magnet when the engaging component contacts the coupling component, and wherein the first storage component part comprises a threaded recess portion that is threaded with a third thread and the coupling component comprises a threaded protrusion portion that is threaded with a fourth thread that corresponds to the third thread to enable the first storage component part and the coupling component to be screwed together via the threaded recess portion and the threaded protrusion portion, to guide the engaging component toward the at least one magnet or a ferromagnetic material of the coupling component to engage with the coupling component via the magnetic force.

8. The portable storage container unit of claim 7, comprising an accessory component attached to the second storage component part, wherein the accessory component comprises at least one of a holder for the portable item or a stand for the portable item.

9. The portable storage container unit of claim 7, wherein the coupling component is configured to be coupled to the portable item via an adhesive component.

10. The portable storage container unit of claim 7, wherein the first storage component part is threaded with a first thread and the second storage component part is threaded with a second thread that corresponds to the first thread to enable the first storage container and the second storage component part to be screwed together.

11. The portable storage container unit of claim 2, wherein the recess is formed with a ring-shaped structure on a flat plate and the protruded portion is a cylinder having an outer diameter being substantially same as an inner diameter of the ring-shaped structure.

12. The portable storage container unit of claim 7, wherein the first storage component part includes an engaging component receiving channel with a channel recess to receive the engaging component, and the engagement component is inserted into and attached to the engaging component receiving channel.

13. The portable storage container unit of claim 12, wherein the engagement component is placed at an outer peripheral portion of the threaded recess portion of the first storage component part.

14. A portable storage container unit, comprising:

a coupling component configured to be coupled to a portable item; and a portable storage container comprising:

an engaging component configured to detachably engage with the coupling component; and a storage component attached to the engaging component, the storage component comprising:

a first storage component part with the engaging component attached to one side of the first storage component part, the first storage component part being configured to detachably coupled to the coupling component via the engaging component, and a second storage component part configured to detachably couple to the first storage component part, wherein the coupling component includes one or more lock components that fit into one or more lock grooves of the first storage component part, and wherein the first storage component part is rotated in a first direction to lock the first storage component part and the coupling component in a locked state and is rotated in a second direction opposite of the first direction to place the first storage component part and the coupling component in an unlocked state to detach the first storage component part from the coupling component, and wherein the engaging component comprises a magnet and the coupling component comprises at least one magnet or a ferromagnetic material to detachably engage with the engaging component via magnetic force of the magnet when the engaging component contacts the coupling component.

15. The portable storage container of claim 14, wherein the first storage component part includes a locking path, and wherein when the first storage component part is rotated in the first direction to lock the first storage component part and the coupling component, the one or more lock components of the coupling component move along the locking path in the first direction within the first storage component part to lock the first storage component part and the coupling component in the locked state, and wherein when the first storage component part is rotated in the second direction to unlock the first storage component part and the coupling component, the one or more lock components of the coupling component move along the locking path in the second direction within the first storage component part to place the first storage component part and the coupling component in the unlocked state.

16. The portable storage container unit of claim 15, wherein the coupling component and the engaging component in the unlocked state that are engaged together via the magnetic force are disengaged from each other when a pulling force greater than the magnetic force is applied in an opposite direction of the magnetic force.

17. The portable storage container unit of claim 14, comprising an accessory component attached to the second storage component part, wherein the accessory component comprises at least one of a holder for the portable item or a stand for the portable item.

18. The portable storage container unit of claim 14, wherein the coupling component is configured to be coupled to the portable item via an adhesive component.

19. The portable storage container unit of claim 14, wherein the first storage component part is threaded with a first thread and the second storage component part is threaded with a second thread that corresponds to the first thread to enable the first storage container and the second storage component part to be screwed together.

* * * * *